US010065066B1

(12) United States Patent
Yassin

(10) Patent No.: US 10,065,066 B1
(45) Date of Patent: Sep. 4, 2018

(54) WEIGHT EXERCISING HARNESS

(71) Applicant: Shamir Yassin, Brooklyn, NY (US)

(72) Inventor: Shamir Yassin, Brooklyn, NY (US)

( * ) Notice: Subject to any disclaimer, the term of this patent is extended or adjusted under 35 U.S.C. 154(b) by 227 days.

(21) Appl. No.: 15/263,586

(22) Filed: Sep. 13, 2016

(51) Int. Cl.
*A63B 21/065* (2006.01)
*A63B 21/00* (2006.01)
*A63B 23/04* (2006.01)

(52) U.S. Cl.
CPC ..... *A63B 21/065* (2013.01); *A63B 21/4009* (2015.10); *A63B 21/4039* (2015.10); *A63B 23/04* (2013.01)

(58) Field of Classification Search
CPC ..... A63B 21/065
See application file for complete search history.

(56) References Cited

U.S. PATENT DOCUMENTS

| | | | | |
|---|---|---|---|---|
| 882,181 | A * | 3/1908 | Thomas | A63B 21/4017 482/139 |
| 3,751,031 | A | 8/1973 | Yamauchi | |
| 4,911,434 | A | 3/1990 | Herring | |
| 4,984,786 | A | 1/1991 | Lemke | |
| 5,588,940 | A | 12/1996 | Price | |
| 7,081,071 | B2 | 7/2006 | Smith | |
| 2007/0287609 | A1 | 12/2007 | McBride | |
| 2014/0256519 | A1 | 9/2014 | Nelson | |

* cited by examiner

*Primary Examiner* — Loan H Thanh
*Assistant Examiner* — Rae Fischer

(57) ABSTRACT

The weight exercising harness is adapted for use with a dip belt. The weight exercising harness is adapted for use with one or more weight plates. The weight exercising harness is an apparatus that attaches the one or more weight plates to the dip belt. The weight exercising harness is adapted for use with a person. The weight exercising harness comprises a thigh segment, a knee segment, a leg cushion, and a lock pin. The thigh segment attaches to the knee segment using the lock pin. The leg cushion is mounted on the exterior of the thigh segment for the purpose of protecting both legs of the person.

7 Claims, 4 Drawing Sheets

WEIGHT EXERCISING HARNESS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise apparatus for strengthening the muscles through the use of a counter force, more specifically, a belt accessory that attaches weights to the body of the exerciser.

SUMMARY OF INVENTION

The weight exercising harness is an apparatus that attaches one or more weight plates to a dip belt. The weight exercising harness is adapted for use with the dip belt. The weight exercising harness is adapted for use with one or more weight plates.

These together with additional objects, features and advantages of the weight exercising harness will be readily apparent to those of ordinary skill in the art upon reading the following detailed description of the presently preferred, but nonetheless illustrative, embodiments when taken in conjunction with the accompanying drawings.

In this respect, before explaining the current embodiments of the weight exercising harness in detail, it is to be understood that the weight exercising harness is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the weight exercising harness.

It is therefore important that the claims be regarded as including such equivalent construction insofar as they do not depart from the spirit and scope of the weight exercising harness. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
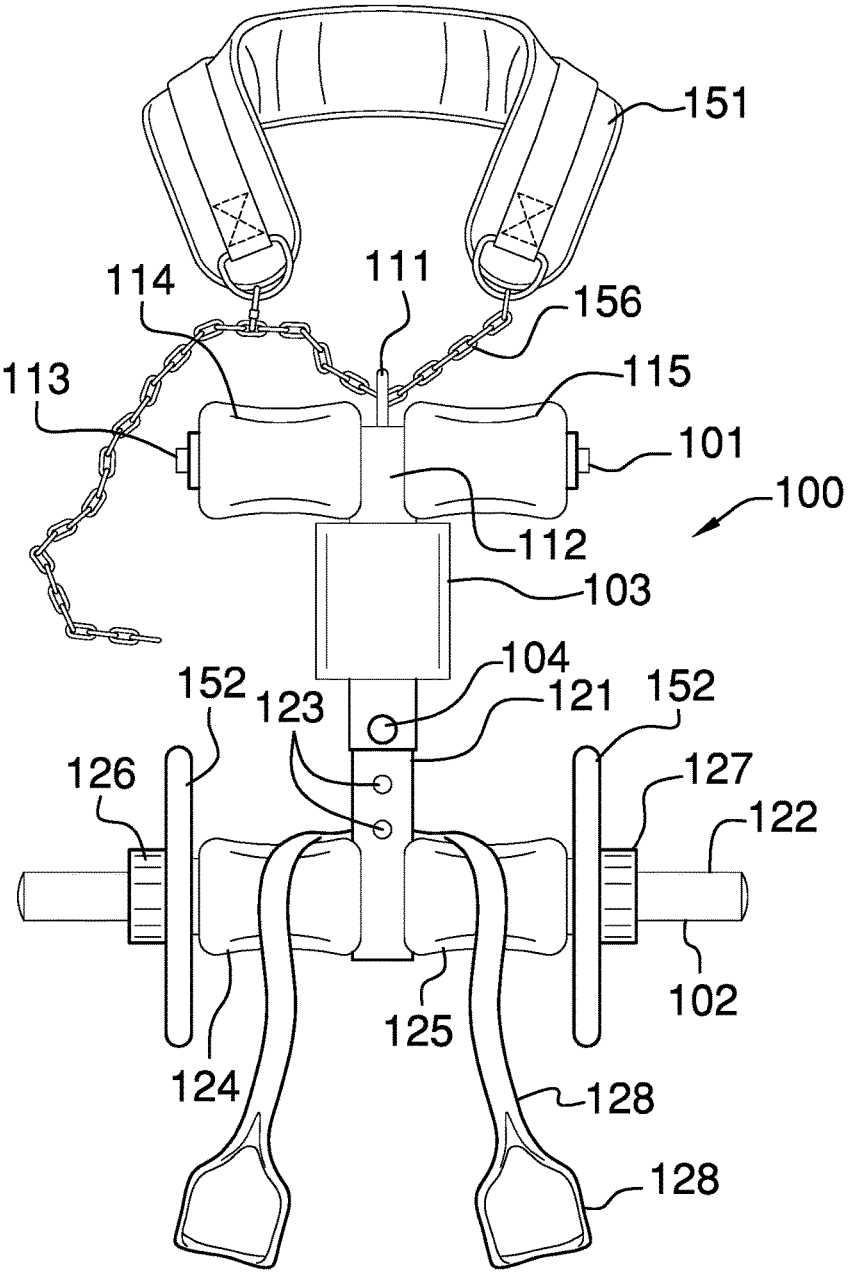
FIG. 1 is a front view of an embodiment of the disclosure.
Figure 2:
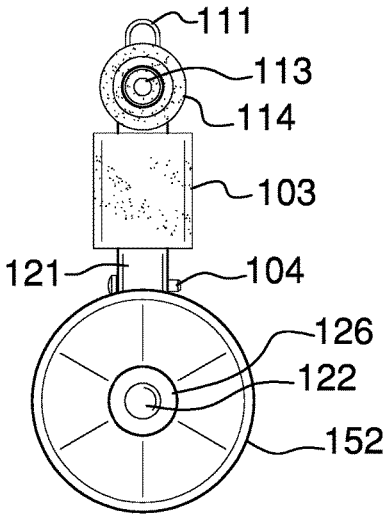
FIG. 2 is a side view of an embodiment of the disclosure.
Figure 3:
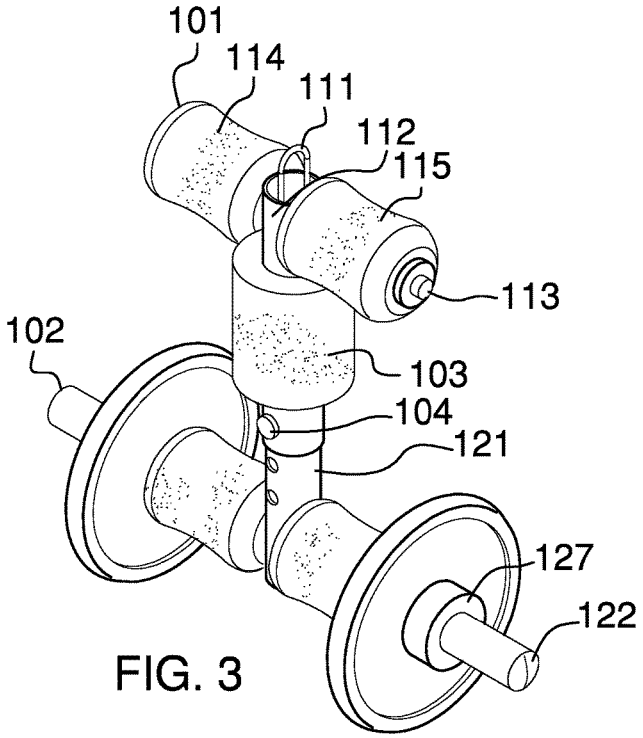
FIG. 3 is a perspective view of an embodiment of the disclosure.
Figure 4:
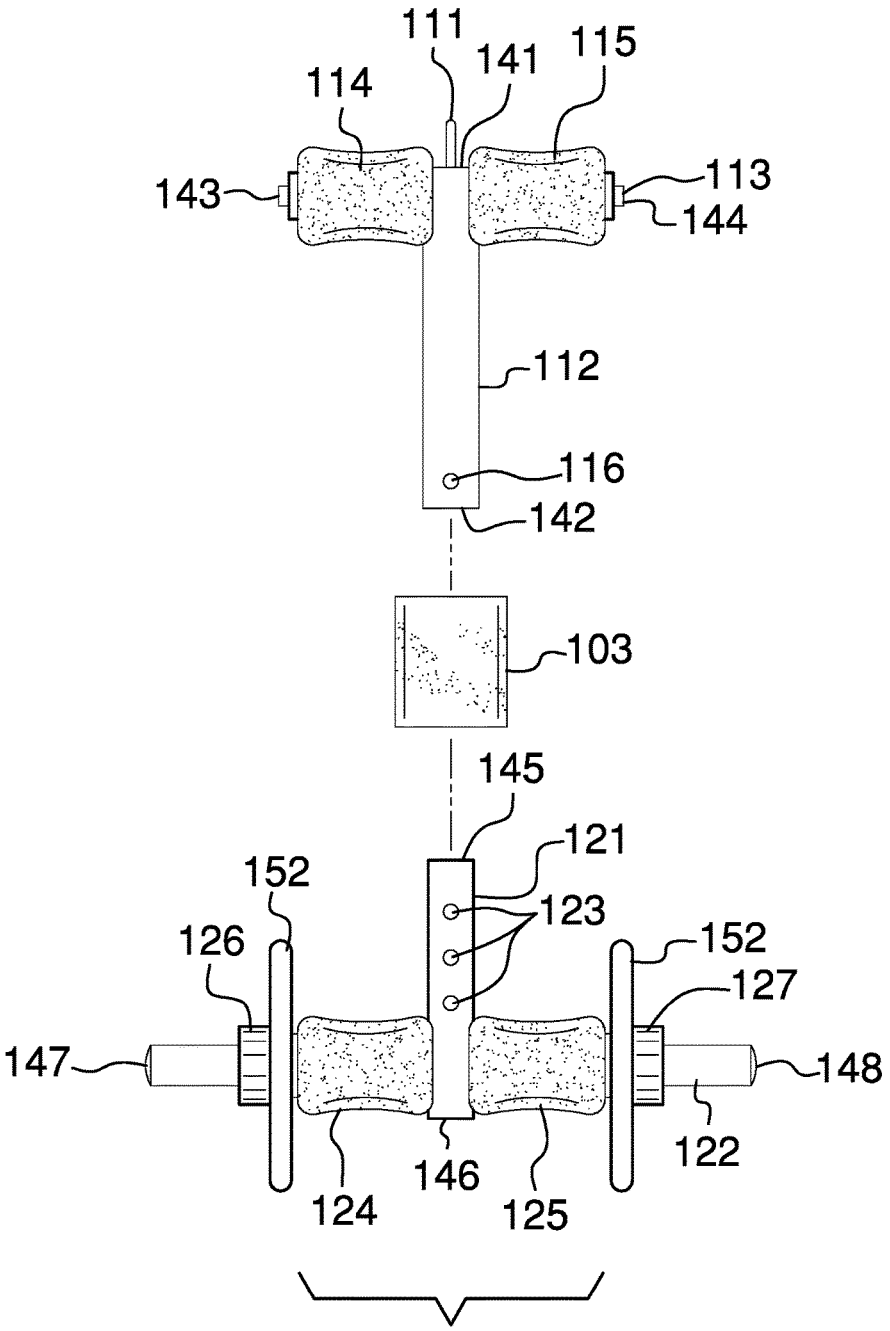
FIG. 4 is an exploded view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The weight exercising harness 100 (hereinafter invention) comprises a thigh segment 101, a knee segment 102, a leg cushion 103, and a lock pin 104. The thigh segment 101 attaches to the knee segment 102 using the lock pin 104. The leg cushion 103 is mounted on the exterior of the thigh segment 101 for the purpose of protecting both legs 154 of the person 153. The invention 100 is adapted for use with a dip belt 151. The invention 100 is adapted for use with a person 153. The invention 100 is adapted for use with one or more weight plates 152. The invention 100 is an apparatus that attaches the one or more weight plates 152 to the dip belt 151.

The thigh segment 101 comprises a ring 111, an extension shaft 112, a thigh bar 113, a first cushion 114, a second cushion 115, and a first pin hole 116. The extension shaft 112 is further defined with a first end 141 and a second end 142. The thigh bar 113 is further defined with a third end 143 and a fourth end 144. The ring 111 and the thigh bar 113 are attached to the extension shaft 112. The first pin hole 116 is a hole that is formed within the extension shaft 112. The first cushion 114 and the second cushion 115 are attached to the thigh bar 113.

The extension shaft 112 is a first pipe that is formed as a capped pipe. The first end 141 of the extension shaft 112 is the capped end of the first pipe. The thigh bar 113 is a second pipe that is attached to the extension shaft 112 such that the center axis of the thigh bar 113 intersects perpendicularly with the center axis of the extension shaft 112. Methods to join pipes in this manner are well known and documented in this disclosure. In alternate embodiments of this disclosure, the thigh bar 113 can be formed from two individual pipes. Those skilled in the art will recognize that this modification can be readily implemented without undue experimentation and would not significantly alter the inventive concepts described within this disclosure. The thigh bar 113 attaches to the extension shaft 112 in a location proximal to the first end 141 of the extension shaft 112. The first pin hole 116 is a hole that is formed within the face of the extension shaft 112 in a location proximal to the second end 142 of the extension shaft 112. The first pin hole 116 is further defined with a first pin hole 116 diameter.

As shown most clearly in FIG. 1, the first cushion 114 is a commercially available padded material that is wrapped around the thigh bar 113 between the third end 143 and the extension shaft 112. The second cushion 115 is a commercially available padded material that is wrapped around the thigh bar 113 between the fourth end 144 and the extension shaft 112. The purpose of the first cushion 114 and the second cushion 115 is to protect the thighs 155 of the leg 154 of the person 153 using the invention 100. The ring 111 is a looped structure that is attached to the capped end of the first end 141 of the extension shaft 112. The ring 111 is the structure to which the dip belt 151 is attached. In many dip belts 151, the invention 100 attaches to the dip belt 151 through the insertion of a chain 156 attached to the dip belt 151.

The knee segment 102 further comprises a primary shaft 121, a weight bar 122, a plurality of adjustment holes 123, a third cushion 124, a fourth cushion 125, a first collar 126, a second collar 127, and a stirrup 128. The primary shaft 121 is further defined with a fifth end 145 and a sixth end 146. The weight bar 122 is further defined with a seventh end 147 and an eighth end 148. The weight bar 122 is attached the primary shaft 121. The plurality of adjustment holes 123 is formed in the primary shaft 121. The third cushion 124, the fourth cushion 125, the first collar 126, the second collar 127 and the stirrup 128 are attached to the weight bar 122.

The primary shaft 121 is a capped third pipe. The sixth end 146 of the primary shaft 121 is the capped end of primary shaft 121. The outer diameter of the primary shaft 121 is lesser than the inner diameter of the extension shaft 112. The span of the center axis of the primary shaft 121 is lesser than the span of the center axis of the extension shaft 112. The weight bar 122 is a fourth pipe that is attached to the primary shaft 121 such that the center axis of the weight bar 122 intersects perpendicularly with the center axis of the primary shaft 121. Methods to join pipes in this manner are well known and documented in this disclosure. In alternate embodiments of this disclosure, the weight bar 122 can be formed from two individual pipes. Those skilled in the art will recognize that this modification can be readily implemented without undue experimentation and would not significantly alter the inventive concepts described within this disclosure.

The weight bar 122 attaches to the primary shaft 121 in a location proximal to the sixth end 146 of the primary shaft 121. The weight bar 122 is sized such that a weight plate selected from the one or more weight plates 152 can be slid over an end selected from the group consisting of the seventh end 147 of the weight bar 122 or the eighth end 148 of the weight bar 122. The plurality of adjustment holes 123 are apertures that are formed in the face of the primary shaft 121. The purpose of any adjustment hole selected from the plurality of adjustment holes 123 is to: 1) align with the first pin hole 116 when the extension shaft 112 is inserted into the primary shaft 121; and, 2) receive the lock pin 104 such that the lock pin 104 will hold the extension shaft 112 and the primary shaft 121 in a fixed position relative to each other. The selection of a specific adjustment hole from the plurality of adjustment holes 123 is determined by the size of the person 153 using the invention 100.

The third cushion 124 is a padded material that is wrapped around the weight bar 122 between the seventh end 147 of the weight bar 122 and the primary shaft 121. The purpose of the third cushion 124 is to protect the leg 154 of the person 153 during use of the invention 100. The fourth cushion 125 is a padded material that is wrapped around the weight bar 122 between the eighth end 148 of the weight bar 122 and the primary shaft 121. The purpose of the fourth cushion 125 is to protect the leg 154 of the person 153 during use of the invention 100. The first collar 126 is a commercially available device that is used secure a weight plate selected from the one or more weight plates 152 that have been slipped over the seventh end 147 of the weight bar 122 such that the selected weight plate will not fall off the weight bar 122.

The second collar 127 is a commercially available device that is used secure a weight plate selected from the one or more weight plates 152 that have been slipped over the eighth end 148 of the weight bar 122 such that the selected weight plate will not fall off the weight bar 122. Several types of collars for securing weight plates to weight bars 122 are well known within the mechanical arts and strength training communities. The stirrup 128 is formed from a webbing. During use, the stirrup 128 is wrapped around the junction of the weight bar 122 and the primary shaft 121 before the person 153 places their feet 157 into the stirrup 128. The purpose of the stirrup 128 is to stabilize the invention 100 during use.

The lock pin 104 is a cotter pin. The lock pin 104 is sized such that the lock pin 104 inserts into the first pin hole 116. The lock pin 104 is sized such that the lock pin 104 inserts into any adjustment hole selected from the plurality of adjustment holes 123. The lock pin 104 inserts through the first pin hole 116 and an adjustment hole selected from the plurality of adjustment holes 123 such that lock pin 104 secures the thigh segment 101 to the knee segment 102 of the invention 100.

The leg cushion 103 is a padded material that is wrapped around the extension shaft 112 for the purpose of protecting the legs 154 of the person 153. The leg cushion 103 is formed as a cylindrical structure with a hollow center. The inner diameter of the hollow center of the leg cushion 103 is greater that the outer diameter of the primary shaft 121 such that the primary shaft 121 or the extension shaft 112 can be inserted through the leg cushion 103.

Figure 5:
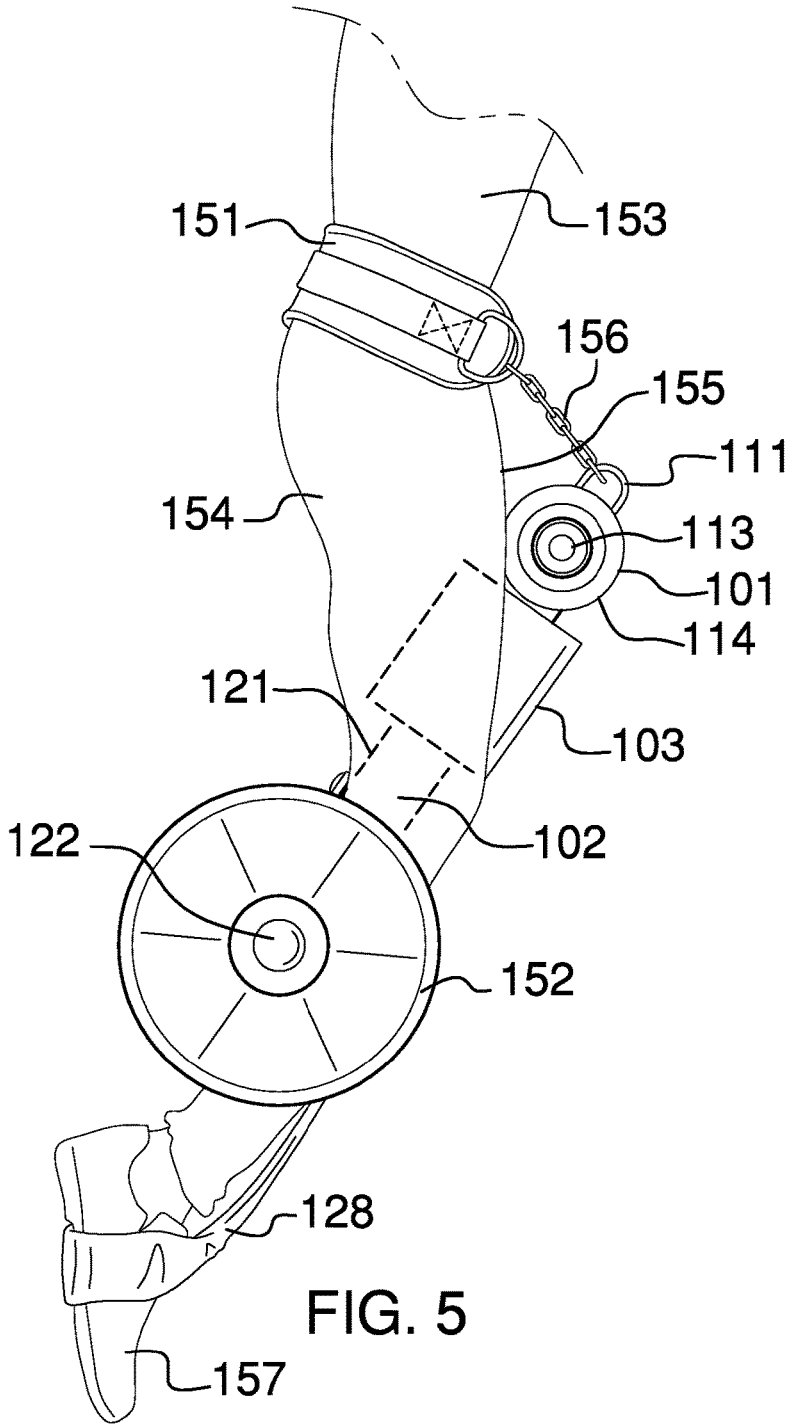
FIG. 5 is an in use view of an embodiment of the disclosure.

The invention 100 is assembled and used as described in this paragraph and the following paragraphs. The inner diameter of the extension shaft 112 is greater than the outer diameter of the primary shaft 121 such that the fifth end 145 of the primary shaft 121 can be inserted into the second end 142 of the extension shaft 112 in a telescopic fashion. The first pin hole 116 is then aligned with an adjustment hole selected from the plurality of adjustment holes 123 such that the lock pin 104 can be inserted through both the first pin hole 116 and the selected adjustment hole. Weight plates selected from the one or more weight plates 152 are placed on the weight bar 122 and are secured to the weight bar 122 using the first collar 126 and the second collar 127. The invention 100 is then attached to the dip belt 151 using the ring 111. As shown in FIG. 5, the person then places the invention 100 around their legs 153 such that the first cushion 114 and the second cushion 115 press against the thigh 155 of the person 153 and the third cushion 124 and the fourth cushion 125 press against the back of the leg 154 of the person 153. The dip belt 151 can then be used normally.

In the first potential embodiment of the disclosure, the ring 111, the extension shaft 112, the thigh bar 113, the primary shaft 121, and the weight bar 122 are formed from commercially available metal pipes and associated end caps.

The ring 111, the lock pin 104, the first collar 126 and the second collar 127 are commercially available. The first cushion 114, the second cushion 115, the third cushion 124 and the fourth cushion 125 are commercially available products. Methods to form holes in metal pipes are well known in the mechanical arts. Methods to attach hardware, such as the ring 111, to the end cap of a pipe, to the end caps of pipes are well known and documented in the mechanical arts.

The following definitions were used in this disclosure:

Capped Pipe: As used in this disclosure, a capped pipe is a pipe with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or cone like structure. When the center axes of two cylinder or like structures share the same line they are said to be aligned. When the center axes of two cylinder like structures do not share the same line they are said to be offset.

Cotter Pin: As used in this disclosure, a cotter pin is a metal shaft that is used to hold two mechanical components together.

Cushion: As used in this disclosure a cushion is a pad or pillow formed from soft material.

Cylinder: As used in this disclosure, a cylinder is a geometric structure defined by two identical flat and parallel ends, also commonly referred to as bases, which are circular in shape and connected with a single curved surface wherein when the cross section of the cylinder remains the same from one end to another. The axis of the cylinder is formed by the straight line that connects the center of each of the two identical flat and parallel ends of the cylinder. In this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment that passes through the center of an object. The line segment of the diameter is terminated at the perimeter or boundary of the object through which the line segment of the diameter runs.

Dip Belt: As used in this disclosure, a dip belt is a strength training devices that is used to attach weights to the body to improve the effectiveness of strength training exercises that use body weight as the primary component of resistance. Such exercises include, but are not limited to, pull ups, chin ups, and dips.

Inner Diameter: As used in this disclosure, the term inner diameter is used in the same way that a plumber would refer to the inner diameter of a pipe.

Loop: As used in this disclosure, a loop is the length of a first linear structure including, but not limited to, lines, cords, or ribbons, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure.

Outer Diameter: As used in this disclosure, the term outer diameter is used in the same way that a plumber would refer to the outer diameter of a pipe.

Pad: As used in this disclosure, a pad is a mass of soft material used as a filling or for protection against damage or injury.

Pipe: As used in this disclosure, the term pipe is used to describe a rigid hollow cylinder. While pipes that are suitable for use in this disclosure are often used to transport or conveys fluids or gasses, the purpose of the pipes in this disclosure are structural.

Stirrup: As used in this disclosure, a stirrup is a webbing that is formed with a loop in each end of the webbing such that a person can be secured to an object, or the object to the person, by securing the webbing to the object and then inserting a first foot of the person through the first loop and the second foot of the person through the second loop.

Telescopic: As used in this disclosure, telescopic is an adjective that describes an object made of sections that fit or slide into each other such that the object can be made longer or shorter by adjusting the relative positions of the sections.

Textile: As used in this disclosure, a textile is a material that is woven, knitted, braided or felted. Synonyms in common usage for this definition include fabric and cloth.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An exercise apparatus comprising:

a thigh segment having:

an extension shaft formed of a pipe and having a pin hole formed within one wall of the pipe;

a ring affixed to one end of the extension shaft and configured to allow attachment of the exercise apparatus to a chain;

a thigh bar mounted through the extension shaft such that the center axis of the thigh bar intersects perpendicularly with the center axis of the extension shaft; and a pair of thigh cushions formed of padded material and affixed to opposing ends of the thigh bar; and a knee segment having:

a primary shaft formed of a pipe and having a plurality of adjustment holes formed within one wall of the pipe and configured to connect telescopically with the extension shaft;

a weight bar mounted through the primary shaft such that the center axis of the weight bar intersects perpendicularly with the center axis of the primary shaft;

a pair of knee cushions formed of padded material and affixed the weight bar to either side of the primary shaft; and a pair of collars configured to mount to either end of the weight bar.

2. The exercise apparatus according to claim 1, wherein the weight bar is configured for mounting of a weight plate at either end of the weight bar, and wherein the collars are each configured to secure a weight plate to the weight bar.

3. The exercise apparatus according to claim 1, wherein the plurality of adjustment holes are configured to align with the pin hole when the primary shaft and extension shaft are connected;

wherein the aligned adjustment hole and pin hole are configured to receive a lock pin to hold the extension shaft and the primary shaft in a fixed position relative to each other.

4. The exercise apparatus according to claim 3, wherein the lock pin is a cotter pin.

5. The exercise apparatus according to claim 1, further comprising a stirrup formed of webbing material and having a pair of loops at either end of the stirrup, wherein the stirrup is configured to be wrapped around the junction of the weight bar and the primary shaft, and wherein the loops are configured for insertion and support of the user's foot.

6. The exercise apparatus according to claim 1, further comprising a leg cushion formed as a hollow cylinder, wherein the inner diameter of the hollow center of the leg cushion is greater than the outer diameter of the extension shaft and the primary shaft.

7. The exercise apparatus according to claim 6, wherein the leg cushion is configured to wrap around the extension shaft.

* * * * *